US010102749B1

(12) United States Patent
Wagner

(10) Patent No.: US 10,102,749 B1
(45) Date of Patent: Oct. 16, 2018

(54) SYSTEM AND METHOD FOR LOCATING MISPLACED KEYS AND KEY FOBS

(71) Applicant: Robert M. Wagner, Woodstock, IL (US)

(72) Inventor: Robert M. Wagner, Woodstock, IL (US)

( * ) Notice: Subject to any disclaimer, the term of this patent is extended or adjusted under 35 U.S.C. 154(b) by 0 days.

(21) Appl. No.: 15/657,736

(22) Filed: Jul. 24, 2017

(51) Int. Cl.
*G08G 1/13* (2006.01)
*G08B 21/24* (2006.01)

(52) U.S. Cl.
CPC ..... *G08G 1/13* (2013.01); *G08B 21/24* (2013.01)

(58) Field of Classification Search
CPC ..... G08G 1/13; G08B 21/24
USPC ..... 340/990
See application file for complete search history.

(56) References Cited

U.S. PATENT DOCUMENTS 7,064,663 B2 6/2006 Pucci et al.
8,237,591 B2 8/2012 Holcomb et al.
8,471,706 B2 6/2013 Schuster et al.
8,847,731 B2 * 9/2014 Tieman ..... B60R 25/24 340/425.5
8,983,537 B2 3/2015 Johnson
9,168,895 B2 * 10/2015 Hatton ..... B60R 25/24
9,330,541 B1 5/2016 Ortiz
9,514,630 B1 12/2016 Steven
9,520,062 B2 * 12/2016 Tucker ..... G01C 21/206
2007/0252696 A1 11/2007 Belisle et al.
2008/0167806 A1 7/2008 Wheeler et al.
2009/0091477 A1 * 4/2009 McCall ..... G01S 19/42 340/990
2009/0309709 A1 * 12/2009 Bevacqua ..... B60R 25/102 340/426.18
2010/0060452 A1 * 3/2010 Schuster ..... G06Q 10/06 340/572.1
2010/0094482 A1 4/2010 Schofield et al.
2011/0257817 A1 * 10/2011 Tieman ..... B60R 25/24 701/2
2012/0056758 A1 * 3/2012 Kuhlman ..... G08G 1/14 340/932.2
2014/0173439 A1 6/2014 Gutierrez et al.
2015/0235487 A1 * 8/2015 Proefke ..... G07C 9/00007 340/5.61
2015/0379859 A1 * 12/2015 Nespolo ..... G08B 21/24 340/539.32
2016/0240067 A1 8/2016 London
(Continued)

*Primary Examiner* — Ojiako K Nwugo
(74) *Attorney, Agent, or Firm* — Scherrer Patent & Trademark Law, P.C.; Stephen T. Scherrer; Monique A. Morneault

(57) ABSTRACT

The present disclosure relates to a locating system and method for use generally by vehicle dealerships to locate vehicle keys that have been misplaced or lost. The system includes a key or key fob having a built-in communication device. When the key is lost, the communication device of the missing key fob is configured to sync-up to a nearby transceiver located in any one of several possible vehicles in a parking lot. Each vehicle would include a location device, such as one with GPS tracking capability, which is connected to a central processor. Once the key fob is synced with a target vehicle, the location of the target vehicle and therefore, the associated key fob, is transmitted back to the central processor. The location of the vehicle is subsequently transmitted to a to a mobile communication device capable of displaying the location of the vehicle and key fob.

20 Claims, 3 Drawing Sheets

(56) References Cited

U.S. PATENT DOCUMENTS

| | | | | |
|---|---|---|---|---|
| 2016/0335878 | A1 | 11/2016 | Steven | |
| 2017/0092030 | A1* | 3/2017 | Badger, II | B60R 25/102 |
| 2017/0105101 | A1* | 4/2017 | Santavicca | H04B 17/27 |
| 2017/0120867 | A1* | 5/2017 | Beauvais | B60R 25/24 |
| 2017/0200336 | A1* | 7/2017 | Schmidt | G07C 9/00174 |

* cited by examiner

SYSTEM AND METHOD FOR LOCATING MISPLACED KEYS AND KEY FOBS

TECHNICAL FIELD

The present disclosure relates to systems and methods for locating misplaced keys and key fobs. More specifically, a system and method is provided for tracking and locating misplaced keys, generally keys and/or key fobs for vehicles, wherein location of the missing key fob is determined through wireless electronic communication of the key fob with a positioning device within a vehicle or plurality of vehicles. The information relating to the location of the missing key fob is determined relative to the location of the target vehicle or plurality of vehicles, and then transmitted to a mobile electronic communication device, so that the missing key fob can be located by the user.

BACKGROUND

Dealerships for passenger motorized vehicles, including passenger cars, motorcycles, and personal and commercial trucks, may include hundreds, if not thousands of vehicles on a particular lot. Key cabinets are often used by dealerships as a central location where all of the keys and/or key fobs are located; however, returning keys and or key fobs to the cabinet may not always happen on a timely basis. Sales personnel may forget to return a particular key to the central cabinet, lose a key, or forget to remove a key from a vehicle. Thus, the combination of a large vehicle inventory with multiple sales personnel, and potentially hundreds of customers test-driving vehicles, keys and/or key fobs are most certainly misplaced or lost. Misplaced keys can be frustrating for sales personnel who need to find a particular vehicle for a customer to test-drive, and keeping a customer waiting may result in a dissatisfied customer and potentially a lost sale.

Lost and misplaced keys is not limited to the sales area. Customers bringing cars in for service can become frustrated if kept waiting while a search is conducted for lost or misplaced keys. Sometimes the service department does not know where a particular vehicle is parked after service is performed, or where the customer's keys have been placed. Customers can become frustrated if kept waiting while a search is conducted for either his/her missing car, and/or missing keys. Failure in customer service may result in lost future business from customers.

A need exists for improved systems and methods for tracking and locating misplaced keys. Specifically, a need exists for improved systems and methods for locating misplaced keys or key fobs for vehicles more quickly and easily.

A further need exists for a system and method for tracking and locating misplaced vehicle keys using the location of at least one target vehicle, wherein the vehicle includes a positioning device that communicates wirelessly with the missing key or key fob.

Moreover, a need exists for a system and method for tracking and locating misplaced vehicle keys, wherein the location of the missing key or key fob can be determined based on the location of at least one target vehicle.

A further need exists for a system and method for tracking and locating misplaced vehicle keys using a mobile communication device, where the determined location of the missing key fob, based on the location of at least one target vehicle, is transmitted to the mobile communication device.

Additionally, a need exists for a system and method for tracking and locating misplaced vehicle keys using a mobile communication device that communicates and receives location information from the signal communication between at least one target vehicle when that target vehicle is in communication with the missing key or key fob.

SUMMARY

The present disclosure relates to a locating system and method for use generally by vehicle dealerships to locate vehicle keys that have been misplaced or lost. The system includes a key or key fob having a built-in communication device, such as a Bluetooth-enabled device. When the key is lost, the communication device of the missing key fob is configured to sync-up to a nearby receiver, such a Bluetooth-enabled device in any one of several possible vehicles in a parking lot. Each vehicle would include a location device, such as one with GPS tracking capability, which is connected to a central processor. Once the key fob is synced with a target vehicle, the location of the target vehicle and the associated key fob is transmitted back to the central processor, and subsequently to a mobile communication device. The mobile communication device is capable of displaying the location of the vehicle and key fob.

Once a key or key fob is synced with a vehicle nearby the key fob, that target vehicle transmits an alert or signal to the central processor advising that the vehicle is synced with the missing key, thereby providing the location of the vehicle and the key that is in the vicinity in or around the vehicle. An alert or transmission is then sent from the central processor to a mobile communication device, such as a smartphone, giving the location of the target vehicle and presumably the missing key. The present locating system can be initiated by a user through a software application or "app" loaded onto an appropriate mobile communication device.

To this end, in an embodiment of the present invention, a system for locating misplaced keys and/or key fobs, is provided. The system comprises a central processor for receiving and transmitting communication signals, a plurality of vehicles, each vehicle including a positioning device, wherein the positioning device of each vehicle is capable of sending a signal to the central processor to provide a position location for each vehicle, a key fob having a built-in communication device configured to communicate with each vehicle, and a mobile communication device configured to receive the communication signal from the central processor and display a location of a vehicle in communication with the key fob.

In another embodiment, a method of tracking and locating misplaced keys and key fobs, is provided. The method comprises the steps of receiving and transmitting communication information through a central processor, transmitting location information from a plurality of vehicles to the central processor, providing a position location for each vehicle, providing a key fob incorporating a communication device configured to communicate with a positioning device of each vehicle, creating a target vehicle when the key fob communication device communicates directly with at least one of the plurality of vehicles, and transmitting the location information of the target vehicle from its positioning device to the central processor when the vehicle communicates with the key fob communicate device.

The method of tracking and locating misplaced keys, wherein the method further includes the steps of determining a location of the key fob based on a location of the vehicle and, displaying the location of the key fob on a communication device, including a mobile communication device.

It is, therefore, an advantage and objective of the present invention to provide a system and method for locating misplaced keys and/or key fobs using a location of a vehicle or plurality of vehicles within a suitable range of the missing key or key fob.

Another advantage and objective of the present invention is to provide a system and method for using a key or key fob having built-in communication device useful for transmitting a signal to a positioning device within a vehicle that is within range of the key or key fob.

It is yet another advantage and objective of the present invention to provide a system and method wherein a positioning device within a vehicle transmits a signal to a central processor providing a location of that target vehicle when a missing key syncs with the target vehicle or plurality of vehicles.

It is yet another advantage and objective of the present invention to provide a system and method for using a positioning device within a target vehicle to communicate with a central processor, which then relays the position of the target vehicle to a mobile communication device.

Yet another advantage and objective of the present invention is to provide a system and method for pinpointing a location of a missing key and/or key fob based on the location of a target vehicle.

Moreover, it is another advantage and objective of the present invention to provide a system and method for using a mobile communication device for locating missing keys and/or key fobs.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present disclosure relates to a locating system and method for use, generally by vehicle dealerships, to locate keys for vehicles that have been misplaced or lost. The present key locating system and method relate to locating misplaced or lost keys using a communication device, such as a Bluetooth-enabled device, contained within a key body, key fob or key fob assembly, which syncs with a transceiver, such as a Bluetooth-enabled device in a particular vehicle. The synced vehicle becomes the "target" vehicle. The target vehicle also includes a location device, such as a Global Positioning System (GPS)-enabled device. The GPS device sends a signal out to a central processor, which then relays location information relating to the target vehicle, as the transceiver in the target vehicle syncs with the missing key fob. The location information is transmitted back through the central processor to an electronic communication device, preferably a mobile device, such as a smartphone. The location information of the missing key can then be assessed in relation to the location of the target vehicle and displayed on the electronic communication device.

The key locating system and method of the present disclosure can turn a mobile communication device, such as a smartphone, tablet or other mobile communication device into a useful tracking and locating device for locating misplaced keys. For example, through a programmed "Misplaced Key" icon on a mobile communication device, the user can initiate the present key locator system to guide the user to the appropriate location of a missing key fob. The missing key fob's location is based on its approximate position in relation to the location of a target vehicle. Alternatively, the position of a missing key fob may be based on the location of a plurality of target vehicles, such as through a triangulation of locations that pinpoint a position of the missing key fob.

Figure 1:
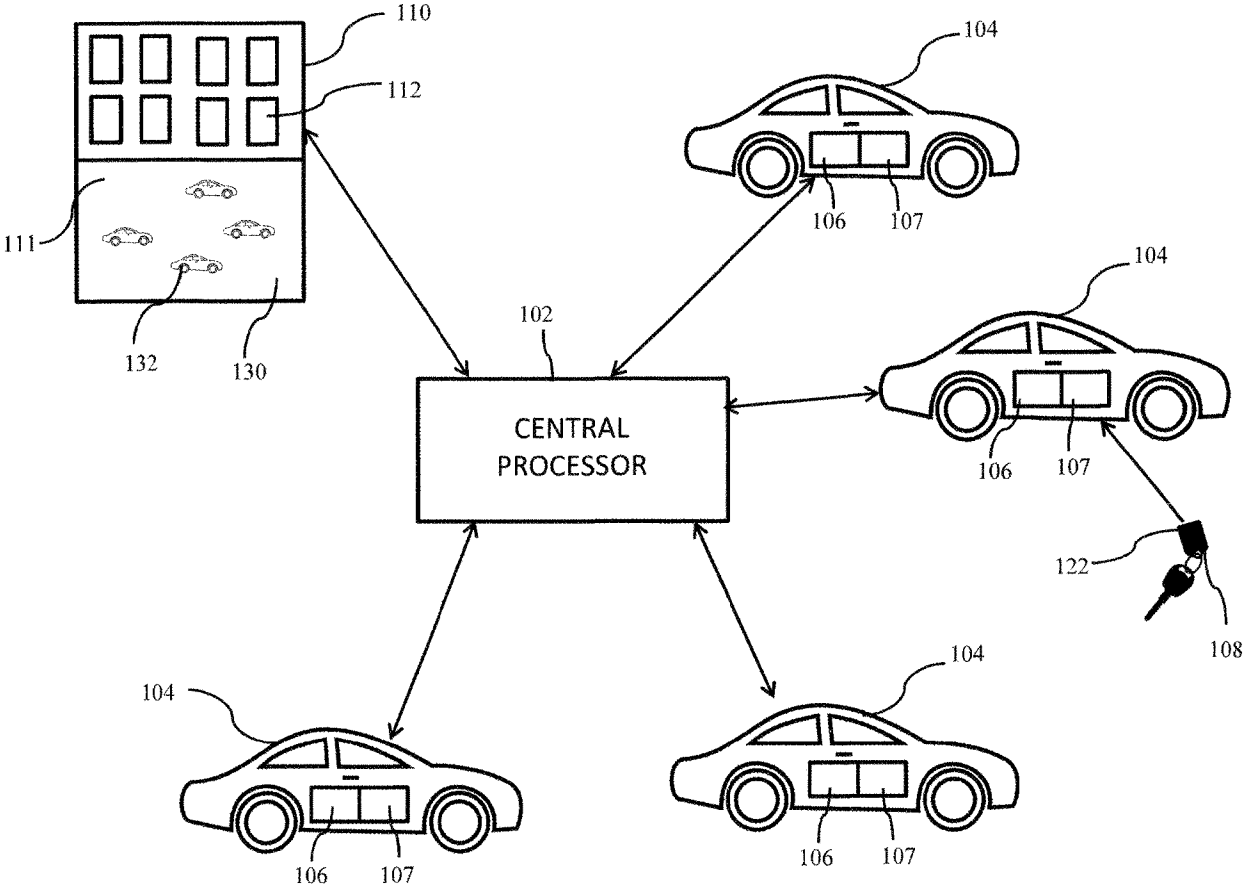
FIG. 1 illustrates a schematic diagram of the key locator system according to an embodiment of the present disclosure.
Figure 2:
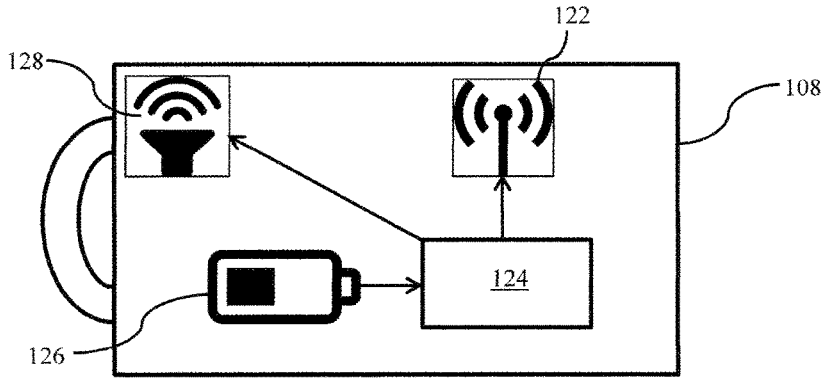
FIG. 2 illustrates a key fob assembly useful in the key locator system according to an embodiment of the present disclosure.
Figure 3:
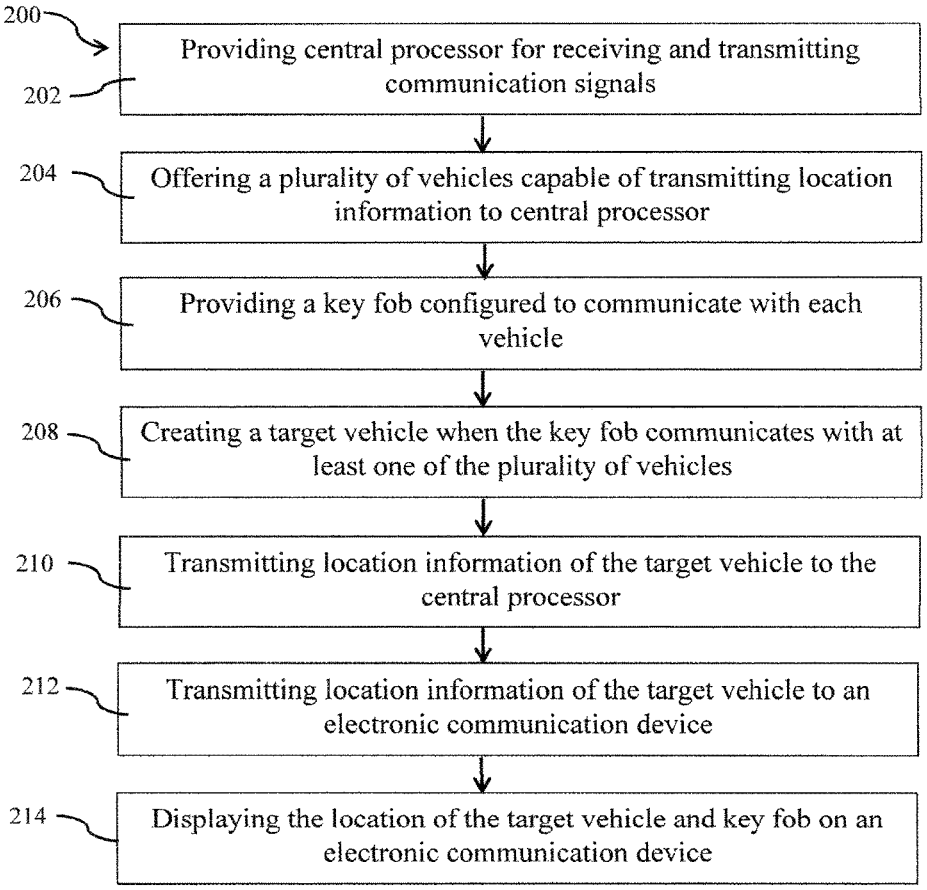
FIG. 3 illustrates a flowchart of a method of locating a missing key fob using the key locator system according to an embodiment of the present disclosure.
Figure 4:
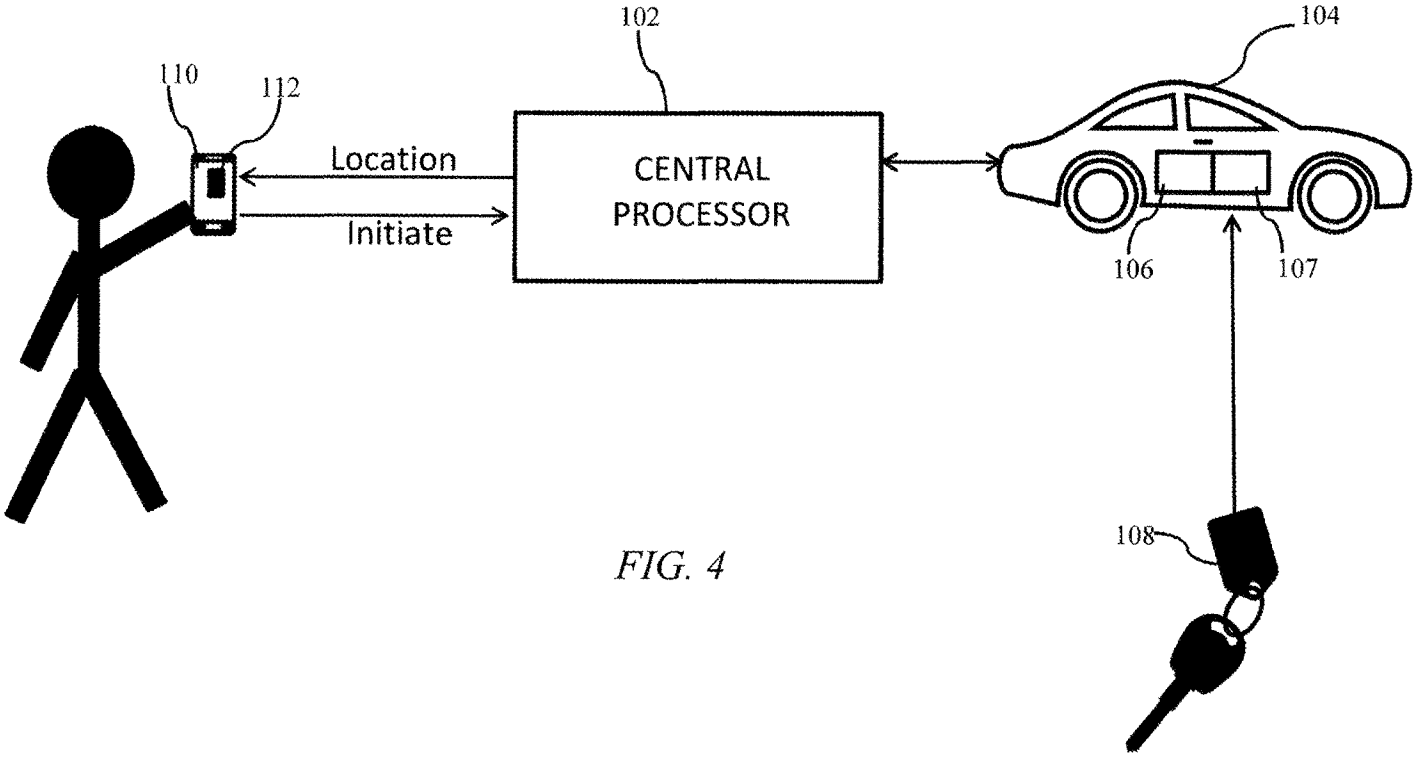
FIG. 4 illustrates a schematic diagram of the method of locating a missing key fob using the key locator system according to an embodiment of the present disclosure.

Now referring to the figures, wherein like numerals refer to like parts, FIG. 1 illustrates an embodiment of the present key locator system 100 of the present disclosure, illustrating the environment of the key locator system 100 in which various devices communicate with a central processor to perform key location and tracking. In an embodiment, the central processor is in communication with a client mobile communication device and a plurality of target vehicles, which are in turn, in communication with a missing key fob. FIG. 2 illustrates an embodiment of a key fob assembly useful in the key locator system according to an embodiment of the present disclosure. FIG. 3 illustrates a flowchart of a method of locating a missing key fob using the key locator system according to an embodiment of the present disclosure. FIG. 4 illustrates a schematic diagram of the method of locating a missing key fob using the key locator system according to an embodiment of the present disclosure.

Referring to FIG. 1, there is shown a schematic diagram of an embodiment of the key locator system 100, according to the present disclosure. The system 100 comprises a central processor or server 102 configured for receiving and transmitting communication signals, a plurality of vehicles 104, each vehicle including a positioning device 106, such as a GPS device, wherein the positioning device of each vehicle is capable of sending a signal to the central processor to provide a position location for each vehicle. Each vehicle 104 further includes a transceiver 107, such as a Bluetooth-enabled device, Wi-Fi enabled device, or any other form of communication protocol. The present system 100 further includes a key fob, or key fob assembly 108, which includes a built-in communication device 122. The transceiver 107 of each vehicle is capable of communicating with the built-in communication device 122 of the key fob 108.

The system 100 further includes a communication device 110, which is configured to receive a communication signal from the central processor 102, when the central processor receives location information from a particular vehicle 104 that is in synced communication with the key fob 108. The location of the vehicle 104 and associated key fob 108 can then be displayed on a display, such as a display screen at the central processor 102, at a desktop computer linked to the central processor, or on a separate communication device 110 so that the user can find the missing key fob.

In an embodiment, the central processor 102 can be a server located in the user/client's office, for example, at a vehicle dealership. The central processor 102 is configured to receive location or position information directly from a plurality of vehicles 104 on the lot at the dealership. Specifically, each vehicle 104 includes its own positioning device 106, such as a GPS device, which sends out and receives location information. The location information may be transmitted to the central processor 102 via satellite (not shown) or via communication protocols, such as GPS or similar technology. Alternatively, the location information of the vehicle 104 may be transmitted through another form of communication protocol, such as Bluetooth, wherein the location information is transmitted to the central processor through a Bluetooth-enabled transmitter, receiver, transponder or transceiver located in the vehicles 104. Location information may comprise geographic coordinates for the target vehicle 104, or some other location identifier, such as a display on a map for example.

As shown in FIG. 2, the present system 100 further includes a key fob 108. Typically, the key fob 108 is a key used to operate a vehicle, whether it is a key actually inserted into the starter of a vehicle or the remote fob that is kept in a location near and within a vehicle for operation of the vehicle. It should also be understood that in the context of the present disclosure, "key fob" or "fob" can be integrated with the keys or separate but attached to the keys, and is anything that is both attached to or integrated with the keys and interacts with the transceiver in vehicles.

Missing and misplaced keys and key fobs are a common problem at dealerships, which may include hundreds, if not thousands, of vehicles on a lot. The present key locator system 100 is useful for locating missing keys and key fobs 108 using the location of at least one or more of the vehicles on the present dealership lot.

The key fob 108 useful in the present key locator system 100 may comprise a removeable housing 120 wherein a variety of known components integral to the operation of the key fob are contained. Notably, the present key fob 108 contains a signal transmitter 122, which is capable of transmitting a signal out to a reciprocal communication device 107 contained within every potential target vehicle 104. The signal transmitter 122 may be a Bluetooth-enabled transmitter, receiver or transponder or transceiver. However, the present disclosure should not be limited as described herein, as any communication protocol apparent to one of ordinary skill in the art may be utilized.

Additionally, the key fob 108 may also contain a microprocessor 124 electrically connected to the signal transmitter 122, and a power supply 126 (for example, a battery) for providing operating power to the key fob. Optionally, the key fob 108 may also include a speaker 128. The microprocessor 124 may be electrically connected to the speaker 128, which may prompted to emit an audible alert for more easily locating the key fob once the general location information for the missing key fob is determined using the present system 100.

Specifically, location information relates to the location of a target vehicle or vehicles 104. Once a particular vehicle 104 positioning device syncs with the signal transmitter of the missing key fob 108, that vehicle becomes a target vehicle, and the location information of the target vehicle is transmitted back to the central processor. Alternatively, location information may also be the result of a triangulation result, meaning that three vehicles are in communication with a missing key fob assembly 108. Thus, the location information may be pinpointed through the triangulation position of the three target vehicles.

Whether the location information is determined by one target vehicle 104 or a triangulation of target vehicles, the location information is transmitted back to the central processor 102. The central processor 102 transfers the information to computer device for display thereon, such as a mobile communication device 110, where the information is displayed on the display screen 111 of the mobile communication device enabling the user to locate the missing key or key fob assembly 108. The displayed information may be in the form of a map view 130, displaying a car icon 132, representing the current location of the synced missing key or key fob assembly 108.

As shown in FIG. 1, the electronic communication device 110 useful in the present system 100, is preferably a mobile communication device, such as a smartphone, tablet or laptop computer. It is of course possible to use a desktop computer as well in the present system 100. When using a desktop computer to locate a missing key fob 108, the location information of the target vehicle 104 and its associated key fob 108 could either be verbally explained, or further transmitted to a mobile communication device.

The chosen electronic communication device 110 would be loaded with the appropriate software application or app used to activate the system 100. For example, the device may show an activation icon 112 labeled as "Misplaced Key." When the user activates the app, the system 100 is initiated to locate the missing key fob 108. The electronic communication device 110 is configured to receive location information from the central processor 102 relating to the position of the specific target vehicle 104 as it syncs with the missing key fob 108. Identification information of the missing key fob 108 may be entered into the app so that the system 100 can search for the missing fob.

Referring now to FIG. 3 there is shown a flowchart illustrating an exemplary method 200 using the key locator system 100 of the present disclosure to locate a missing or misplaced key or key fob 108. As shown, the method comprises the steps of: step one 202: providing a central processor 102 configured for receiving and transmitting communication signals; step two 204: offering a plurality of vehicles 104, each vehicle including a positioning device 106, wherein the positioning device of each vehicle is capable of transmitting a signal to the central processor to provide a position location for each vehicle; step three 206: providing a key fob assembly 108 incorporating a communication device 122 configured to communicate with a transceiving device of each vehicle; step four 208: creating a target vehicle 104 when the key fob assembly 108 when the key fob communication device communicates directly with at least one of the plurality of vehicles; step five 210: transmitting the location information of the target vehicle 104 from its positioning device to the central processor 102; step six 212: transmitting the location information of the target vehicle to an electronic communication device; step seven 214: displaying the location of the target vehicle and key fob on an electronic communication device.

Referring to FIG. 4, in the exemplary embodiment of the method 200 of the present disclosure, a user of a communication device 110, shown in this embodiment as a smartphone, activates an app 112 on the device indicated, for example, as "Find Missing Key" or "Misplaced Key." Identification information (possibly an identification or serial number) of the missing key fob 108 would be entered into the app 112. The smartphone 110 transmits a signal to the central processor 102, which is configured to send and receive location information relating to at least one vehicle 104 located in the general vicinity.

If the missing key fob 108 is in the area of the vehicle or vehicles 104, the Bluetooth-enabled signal transmitter/receiver 122 of the key fob syncs with a complimentary Bluetooth-enabled signal transmitter/receiver 107 of a vehicle 104. The vehicle 104 then becomes the target vehicle. Once the target vehicle 104 syncs with the missing key fob 108, a location signal from the location-enabled device contained within the target vehicle is transmitted from the vehicle to the central processor 102. The central processor 102 in turn transmits the location signal to the mobile communication device 110. The subsequent location information relating to the target vehicle 104 is displayed on the mobile communication device 110, either as a map or text on the screen of the smartphone. By going to the location of the target vehicle 104, the user of the mobile communication device is then able to locate the missing key fob 108.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A system for locating misplaced keys, the system comprising;

a central processor for receiving and transmitting communication signals;

a plurality of vehicles, each vehicle including a positioning device, wherein the positioning device of each vehicle is capable of sending a signal to the central processor to provide a position location for each vehicle;

a key fob having a built-in communication device configured to communicate with each vehicle;

an communication device configured to receive the communication signal from the central processor and display a location of a vehicle that is in communication with the key fob.

2. The system of claim 1, wherein each vehicle further includes a transceiver device.

3. The system of claim 2, wherein the key fob communication device is configured to sync with the transceiver device of each vehicle.

4. The system of claim 3, wherein one of the plurality of vehicles becomes a target vehicle when the key fob communication device syncs with the transceiver device of a particular vehicle.

5. The system of claim 4, wherein the positioning device of the target vehicle is configured to send a signal to the central processor when the key fob device syncs with the target vehicle.

6. The system of claim 5, wherein the central processor is configured to receive the signal from the target vehicle and then transmit the signal to the communication device.

7. The system of claim 6, wherein the communication device is capable of displaying the signal as a location position of the target vehicle.

8. The system of claim 6, wherein the signal may be generated from at least three target vehicles creating a triangulation location position of the target vehicles.

9. The system of claim 7, wherein the signal can be displayed as a sound alert on the communication device.

10. The system of claim 1, wherein the electronic communication device is a mobile communication device.

11. The system of claim 10, wherein the electronic communication device is one of a smartphone, laptop or tablet.

12. The system of claim 1, wherein the electronic communication device is a desktop computer.

13. A method of tracking and locating misplaced keys and key fobs, the method comprising the steps of:

receiving and transmitting communication information through a central processor;

transmitting location information from a plurality of vehicles to the central processor, providing a position location for each vehicle;

providing a key fob incorporating a communication device configured to communicate with a transceiver device of each vehicle;

creating a target vehicle when the key fob communication device communicates directly with at least one of the plurality of vehicles;

transmitting the location information of the target vehicle from its positioning device to the central processor when the vehicle communicates with the key fob communication device.

14. The method of claim 13, the method further include the step of determining a location of the key fob based on a location of the target vehicle.

15. The method of claim 13, the method further including the step of displaying the location of the key fob on an electronic communication device.

16. The method of claim 15, wherein the location is displayed as geographic coordinates.

17. The method of claim 15, wherein the location is displayed as map.

18. The method of claim 13, the method further including the step of creating a triangulation position of the key fob when the key fob communication device communicates with three target vehicles.

19. The method of claim 15, the method further including the step of loading a software application configured to locate a missing key fob onto the communication device.

20. The method of claim 19, wherein the method further includes initiating the software application on the communication device.

* * * * *